US007659827B2

(12) United States Patent
Gunderson et al.

(10) Patent No.: US 7,659,827 B2
(45) Date of Patent: Feb. 9, 2010

(54) SYSTEM AND METHOD FOR TAKING RISK OUT OF DRIVING

(75) Inventors: Charlie Gunderson, La Jolla, CA (US); Tom Lefleur, Rancho Santa Fe, CA (US); Doron Lurie, San Diego, CA (US); Bruce Moeller, San Diego, CA (US)

(73) Assignee: Drivecam, Inc., San Diego, CA (US)

( * ) Notice: Subject to any disclaimer, the term of this patent is extended or adjusted under 35 U.S.C. 154(b) by 428 days.

(21) Appl. No.: 11/382,222

(22) Filed: May 8, 2006

(65) Prior Publication Data

US 2007/0257815 A1 Nov. 8, 2007

Related U.S. Application Data

(63) Continuation-in-part of application No. 11/382,239, filed on May 8, 2006, now abandoned.

(51) Int. Cl.
*G08B 23/00* (2006.01)

(52) U.S. Cl. ..... 340/576; 348/148; 434/66

(58) Field of Classification Search ..... 340/576.439; 434/62–71; 348/148; 709/217, 219; 701/29, 701/32

See application file for complete search history.

(56) References Cited

U.S. PATENT DOCUMENTS 2,943,141 A 6/1960 Knight
3,634,866 A * 1/1972 Meyer ..... 340/901
3,781,824 A 12/1973 Caiati et al.
3,812,287 A 5/1974 Lemelson
3,885,090 A 5/1975 Rosenbaum
3,992,656 A 11/1976 Joy
4,054,752 A 10/1977 Dennis, Jr. et al.
4,271,358 A 6/1981 Schwarz
4,280,151 A 7/1981 Tsunekawa et al.
4,281,354 A 7/1981 Conte
4,401,976 A 8/1983 Stadelmayr
4,409,670 A 10/1983 Herndon et al.
4,420,773 A 12/1983 Toyoda et al.
4,425,097 A * 1/1984 Owens ..... 434/66
4,456,931 A 6/1984 Toyoda et al.

(Continued)

FOREIGN PATENT DOCUMENTS

GB 2 268 608 1/1994

(Continued)

OTHER PUBLICATIONS

International Search Report and Written Opinion issued in PCT/US07/68334 on Mar. 5, 2008.

*Primary Examiner*—Thomas J Mullen
(74) *Attorney, Agent, or Firm*—Steins & Associates, P.C.

(57) ABSTRACT

Systems and methods for taking risk out of driving are presented. The system comprises an event capture device that records audio, video, and other information that collectively comprise an event. The event data, including the audio, video, and other related information, is provided to an evaluation server where it is stored in a database of events. Driving events can be analyzed singularly or collectively to provide counseling of fleet drivers, reconstruction and forensic analysis of automobile accidents, and driver and/or vehicle scores/ratings.

24 Claims, 5 Drawing Sheets

U.S. PATENT DOCUMENTS

| | | | | |
|---|---|---|---|---|
| 4,489,351 | A | | 12/1984 | d'Alayer de Costemore d'Arc |
| 4,496,995 | A | | 1/1985 | Colles et al. |
| 4,500,868 | A | * | 2/1985 | Tokitsu et al. ..... 340/439 |
| 4,533,962 | A | | 8/1985 | Decker et al. |
| 4,558,379 | A | | 12/1985 | Hutter et al. |
| 4,593,313 | A | | 6/1986 | Nagasaki et al. |
| 4,621,335 | A | | 11/1986 | Bluish et al. |
| 4,625,210 | A | | 11/1986 | Sagl |
| 4,630,110 | A | | 12/1986 | Cotton et al. |
| 4,632,348 | A | | 12/1986 | Keesling et al. |
| 4,638,289 | A | | 1/1987 | Zottnik |
| 4,646,241 | A | | 2/1987 | Ratchford et al. |
| 4,651,143 | A | | 3/1987 | Yamanaka |
| 4,758,888 | A | | 7/1988 | Lapidot |
| 4,763,745 | A | | 8/1988 | Eto et al. |
| 4,785,474 | A | | 11/1988 | Bernstein et al. |
| 4,789,904 | A | | 12/1988 | Peterson |
| 4,794,566 | A | | 12/1988 | Richards et al. |
| 4,804,937 | A | | 2/1989 | Barbiaux et al. |
| 4,806,931 | A | | 2/1989 | Nelson |
| 4,814,896 | A | * | 3/1989 | Heitzman et al. ..... 434/65 |
| 4,837,628 | A | | 6/1989 | Sasaki |
| 4,839,631 | A | | 6/1989 | Tsuji |
| 4,843,463 | A | | 6/1989 | Michetti |
| 4,843,578 | A | | 6/1989 | Wade |
| 4,876,597 | A | | 10/1989 | Roy et al. |
| 4,883,349 | A | | 11/1989 | Mittelhauser |
| 4,896,855 | A | | 1/1990 | Furnish |
| 4,930,742 | A | | 6/1990 | Schofield et al. |
| 4,936,533 | A | | 6/1990 | Adams et al. |
| 4,939,652 | A | | 7/1990 | Steiner |
| 4,942,464 | A | | 7/1990 | Milatz |
| 4,945,244 | A | | 7/1990 | Castleman |
| 4,949,186 | A | | 8/1990 | Peterson |
| 4,980,913 | A | | 12/1990 | Skret |
| 4,987,541 | A | | 1/1991 | Levente et al. |
| 4,992,943 | A | | 2/1991 | McCracken |
| 5,012,335 | A | | 4/1991 | Cohodar |
| 5,027,104 | A | | 6/1991 | Reid |
| 5,056,056 | A | | 10/1991 | Gustin |
| 5,057,820 | A | | 10/1991 | Markson et al. |
| 5,096,287 | A | | 3/1992 | Kakinami et al. |
| 5,100,095 | A | | 3/1992 | Haan et al. |
| 5,111,289 | A | | 5/1992 | Lucas et al. |
| 5,140,434 | A | | 8/1992 | Van Blessinger et al. |
| 5,140,436 | A | | 8/1992 | Blessinger |
| 5,144,661 | A | | 9/1992 | Shamosh et al. |
| 5,178,448 | A | | 1/1993 | Adams et al. |
| 5,196,938 | A | | 3/1993 | Blessinger |
| 5,223,844 | A | | 6/1993 | Mansell et al. |
| 5,262,813 | A | | 11/1993 | Scharton |
| 5,308,247 | A | | 5/1994 | Dyrdek |
| 5,311,197 | A | | 5/1994 | Sorden et al. |
| 5,321,753 | A | | 6/1994 | Gritton |
| 5,327,288 | A | | 7/1994 | Wellington et al. |
| 5,330,149 | A | | 7/1994 | Haan et al. |
| 5,343,527 | A | | 8/1994 | Moore |
| 5,353,023 | A | | 10/1994 | Mitsugi |
| 5,361,326 | A | | 11/1994 | Aparicio, IV et al. |
| 5,387,926 | A | | 2/1995 | Bellan |
| 5,388,045 | A | | 2/1995 | Kamiya et al. |
| 5,404,330 | A | | 4/1995 | Lee et al. |
| 5,408,330 | A | | 4/1995 | Squicciarini et al. |
| 5,422,543 | A | | 6/1995 | Weinberg |
| 5,430,431 | A | | 7/1995 | Nelson |
| 5,430,432 | A | | 7/1995 | Camhi et al. |
| 5,435,184 | A | | 7/1995 | Pineroli et al. |
| 5,445,024 | A | | 8/1995 | Riley, Jr. et al. |
| 5,445,027 | A | | 8/1995 | Zorner |
| 5,446,659 | A | | 8/1995 | Yamawaki |
| 5,455,625 | A | | 10/1995 | Englander |
| 5,455,716 | A | | 10/1995 | Suman et al. |
| 5,465,079 | A | * | 11/1995 | Bouchard et al. ..... 340/576 |
| 5,473,729 | A | | 12/1995 | Bryant et al. |
| 5,477,141 | A | | 12/1995 | Nather et al. |
| 5,495,242 | A | | 2/1996 | Kick et al. |
| 5,497,419 | A | | 3/1996 | Hill |
| 5,499,182 | A | | 3/1996 | Ousborne |
| 5,504,482 | A | | 4/1996 | Schreder |
| 5,515,285 | A | | 5/1996 | Garret, Sr. et al. |
| 5,521,633 | A | | 5/1996 | Nakajima et al. |
| 5,523,811 | A | | 6/1996 | Wada et al. |
| 5,526,269 | A | | 6/1996 | Ishibashi et al. |
| 5,530,420 | A | | 6/1996 | Tsuchiya et al. |
| 5,537,156 | A | | 7/1996 | Katayama |
| 5,539,454 | A | | 7/1996 | Williams |
| 5,541,590 | A | | 7/1996 | Nishio |
| 5,544,060 | A | | 8/1996 | Fujii et al. |
| 5,548,273 | A | | 8/1996 | Nicol et al. |
| 5,552,990 | A | | 9/1996 | Ihara et al. |
| 5,559,496 | A | | 9/1996 | Dubats |
| 5,568,211 | A | | 10/1996 | Bamford |
| 5,570,127 | A | | 10/1996 | Schmidt |
| 5,574,443 | A | | 11/1996 | Hsieh |
| D376,571 | S | | 12/1996 | Kokat |
| 5,581,464 | A | | 12/1996 | Woll et al. |
| 5,590,948 | A | | 1/1997 | Moreno |
| 5,596,382 | A | | 1/1997 | Bamford |
| 5,610,580 | A | | 3/1997 | Lai |
| 5,612,686 | A | | 3/1997 | Takano et al. |
| 5,631,638 | A | | 5/1997 | Kaspar et al. |
| 5,638,273 | A | | 6/1997 | Coiner et al. |
| 5,642,106 | A | | 6/1997 | Hancock et al. |
| 5,646,856 | A | | 7/1997 | Kaesser |
| 5,652,706 | A | | 7/1997 | Morimoto et al. |
| RE35,590 | E | | 8/1997 | Bezos et al. |
| 5,654,892 | A | | 8/1997 | Fujii et al. |
| 5,659,355 | A | | 8/1997 | Barron et al. |
| 5,667,176 | A | | 9/1997 | Zamarripa et al. |
| 5,669,698 | A | | 9/1997 | Veldman et al. |
| 5,671,451 | A | | 9/1997 | Takahashi et al. |
| 5,677,979 | A | | 10/1997 | Squicciarini et al. |
| 5,680,117 | A | | 10/1997 | Arai et al. |
| 5,680,123 | A | | 10/1997 | Lee |
| 5,689,442 | A | | 11/1997 | Swanson et al. |
| 5,696,705 | A | | 12/1997 | Zykan |
| 5,706,362 | A | | 1/1998 | Yabe |
| 5,712,679 | A | | 1/1998 | Coles |
| 5,717,456 | A | | 2/1998 | Rudt et al. |
| 5,719,554 | A | | 2/1998 | Gagnon |
| 5,784,521 | A | | 7/1998 | Nakatani et al. |
| 5,790,403 | A | | 8/1998 | Nakayama |
| 5,790,973 | A | | 8/1998 | Blaker et al. |
| 5,793,420 | A | | 8/1998 | Schmidt |
| 5,794,165 | A | | 8/1998 | Minowa et al. |
| 5,797,134 | A | | 8/1998 | McMillian et al. |
| 5,798,458 | A | | 8/1998 | Monroe |
| 5,800,040 | A | | 9/1998 | Santo |
| 5,802,545 | A | | 9/1998 | Coverdill |
| 5,802,727 | A | | 9/1998 | Blank et al. |
| 5,815,093 | A | | 9/1998 | Kikinis |
| 5,825,412 | A | | 10/1998 | Hobson et al. |
| 5,844,505 | A | | 12/1998 | Van Ryzin |
| 5,896,167 | A | | 4/1999 | Omae et al. |
| 5,897,606 | A | | 4/1999 | Miura et al. |
| 5,899,956 | A | | 5/1999 | Chan |
| 5,901,806 | A | | 5/1999 | Takahashi |
| 5,914,748 | A | | 6/1999 | Parulski et al. |
| 5,926,210 | A | | 7/1999 | Hacket et al. |
| 5,946,404 | A | | 8/1999 | Bakshi et al. |
| 5,978,017 | A | | 11/1999 | Tino |
| 6,002,326 | A | | 12/1999 | Turner |
| 6,008,723 | A | | 12/1999 | Yassan |
| 6,008,841 | A | | 12/1999 | Charlson |

| | | | | |
|---|---|---|---|---|
| 6,009,370 | A | 12/1999 | Minowa et al. | |
| 6,011,492 | A | 1/2000 | Garesche | |
| 6,028,528 | A | 2/2000 | Lorenzetti et al. | |
| 6,037,860 | A | 3/2000 | Zander et al. | |
| 6,037,977 | A | 3/2000 | Peterson | |
| 6,064,792 | A | 5/2000 | Fox et al. | |
| 6,092,193 | A | 7/2000 | Loomis et al. | |
| 6,122,738 | A | 9/2000 | Millard | |
| 6,141,611 | A | 10/2000 | Mackey et al. | |
| 6,144,296 | A | 11/2000 | Ishida et al. | |
| 6,151,065 | A | 11/2000 | Steed et al. | |
| 6,163,338 | A | 12/2000 | Johnson et al. | |
| 6,167,186 | A | 12/2000 | Kawasaki et al. | |
| 6,181,373 | B1 | 1/2001 | Coles | |
| 6,185,490 | B1 | 2/2001 | Ferguson | |
| 6,200,139 | B1 * | 3/2001 | Clapper | 434/62 |
| 6,211,907 | B1 | 4/2001 | Seaman et al. | |
| 6,218,960 | B1 | 4/2001 | Ishikawa et al. | |
| 6,246,933 | B1 | 6/2001 | Bague | |
| 6,253,129 | B1 | 6/2001 | Jenkins et al. | |
| 6,679,702 | B1 * | 1/2004 | Rau | 434/62 |
| 7,100,190 | B2 | 8/2006 | Johnson et al. | |
| 2002/0111725 | A1 | 8/2002 | Burge | |
| 2003/0158638 | A1 | 8/2003 | Yakes et al. | |
| 2003/0191568 | A1 | 10/2003 | Breed | |
| 2004/0209594 | A1 | 10/2004 | Naboulsi | |
| 2005/0185936 | A9 | 8/2005 | Lao et al. | |
| 2006/0007151 | A1 | 1/2006 | Ram | |
| 2006/0040239 | A1 | 2/2006 | Cummins et al. | |
| 2006/0055521 | A1 | 3/2006 | Blanco et al. | |
| 2006/0057543 | A1 * | 3/2006 | Roald | 434/62 |
| 2006/0078853 | A1 * | 4/2006 | Lanktree | 434/62 |
| 2006/0092043 | A1 | 5/2006 | Lagassey | |
| 2006/0095175 | A1 * | 5/2006 | deWaal et al. | 701/29 |
| 2006/0242680 | A1 | 10/2006 | Johnson et al. | |

FOREIGN PATENT DOCUMENTS

| | | |
|---|---|---|
| JP | 5-137144 | 6/1993 |
| JP | 5-294188 | 11/1993 |
| JP | 8-124069 | 5/1996 |
| JP | 10-076880 | 3/1998 |
| WO | WO 88/09023 | 11/1988 |
| WO | WO 90/05076 | 5/1990 |
| WO | WO 94/27844 | 12/1994 |
| WO | WO 96/00957 | 1/1996 |
| WO | WO 97/01246 | 1/1997 |
| WO | WO 99/37503 | 7/1999 |
| WO | WO 99/40545 | 8/1999 |
| WO | WO 99/62741 | 12/1999 |
| WO | WO 00/48033 | 8/2000 |
| WO | WO 00/77620 | 12/2000 |
| WO | WO 01/25054 | 4/2001 |

* cited by examiner

SYSTEM AND METHOD FOR TAKING RISK OUT OF DRIVING

The present application is a continuation-in-part of U.S. patent application Ser. No. 11/382,239, filed May 8, 2006, now abandoned and is related to U.S. patent application Ser. Nos. 11/382,325 and 11/382,328, filed May 9, 2006, which is incorporated herein by reference in its entirety.

BACKGROUND

1. Field of the Invention

The present invention generally relates to computer assisted feedback for taking risk out of driving and more specifically relates to event based analysis for counseling of fleet drivers, reconstruction and forensic analysis of automobile accidents, and individualized driver scoring and vehicle rating.

2. Related Art

Conventional systems for taking risk out of driving are non-existent or impractical today. The current state of the art for predicting the driving safety of individual drivers or groups of drivers operating vehicles under certain circumstances is primitive. There are no conventional systems in place today that can objectively reconstruct the exact conditions during an automobile accident. Furthermore, there are no systems in place today that can objectively score an individual driver or an individual vehicle. Accordingly, what is needed is an efficient system and method for monitoring, analyzing, scoring, and predicting the driving safety performance of individual drivers.

SUMMARY

The present invention provides a system and method for computer assisted feedback for taking risk out of driving and more specifically relates to event based analysis for counseling of fleet drivers, reconstruction and forensic analysis of automobile accidents, and individualized driver scoring and vehicle rating. The system comprises an event capture device that records audio, video, and other information that collectively comprise an event. The event data, including the audio, video, and other related information, is provided to an evaluation server where it is stored in a database that aggregates events.

In one embodiment, the events are analyzed and scored and compiled with other event data. Event data may be compiled and analyzed for an individual driver, groups of drivers, individual automobiles and groups of automobiles, where appropriate. Examples of groups may include demographically defined groups (e.g., males age 20-25) or circumstantially defined groups (e.g., night time drivers). Reports for managers and counseling sessions for individual drivers can be created to provide feedback to the organization and individual drivers.

In an alternative embodiment, data for a specific automobile accident event can be analyzed and compared to similar type of automobile accident event data in order to forensically analyze the specific event and determine the cause of the accident. Advantageously, information about the circumstances surrounding the event is captured during the event to provide an analyst with objective information about the event as it took place. For example, specific information may include (but are not limited to) the GPS location of the vehicle, the G-forces acting on the vehicle, the speed and direction of the vehicle, operation or status of vehicle systems such as lights or brakes or engine, and audio and video data from the vehicle during the automobile accident.

In yet another embodiment, aggregate event data in the database of events can be analyzed to identify correlations between events, driving behavior, vehicles, circumstances of events, individual drivers, and other event attributes. These correlations are continuously updated and can be weighted in order to provide a comprehensive analysis of an individual driver resulting in an individualized driver score that can be used as a basis to rate the driver for individualized insurance coverage.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for systems and methods for taking risk out of driving are presented. For example, one embodiment comprises an event capture device that records audio, video, and other information that collectively comprise an event. The event data, including the audio, video, and other related information, is provided to an evaluation server where it is stored in a database of events. Driving events are analyzed singularly or collectively to provide counseling of fleet drivers, reconstruction and forensic analysis of automobile accidents, and driver and/or vehicle scores/ratings.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
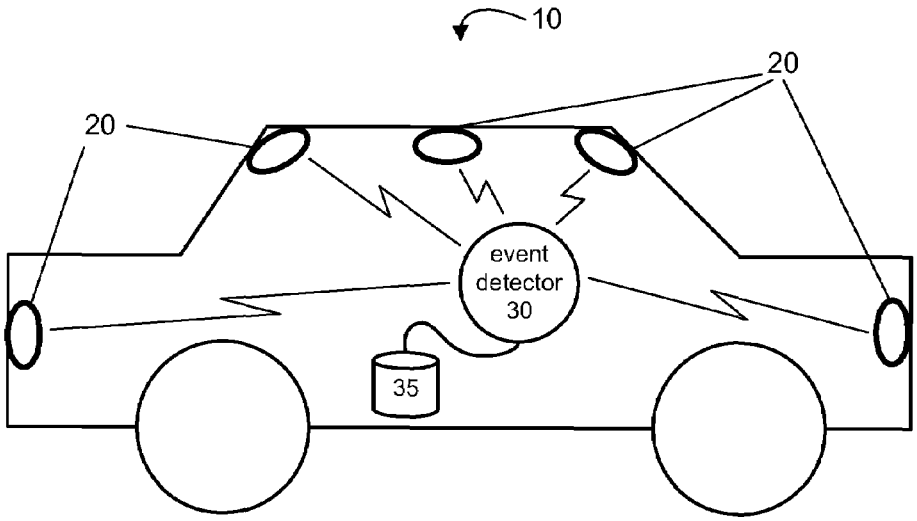
FIG. 1 is a block diagram illustrating an example event detector in control of a plurality of event capture devices deployed in a vehicle according to an embodiment of the present invention.

FIG. 1 is a block diagram illustrating an example event detector 30 in control of a plurality of event capture devices 20 deployed in a vehicle 10 according to an embodiment of the present invention. In the illustrated embodiment, the event detector 30 is integrated with the vehicle 10 and is communicatively coupled with the event capture devices 20. The event detector 30 is also configured with data storage 35.

The event detector 30 can be any of a variety of types of computing devices with the ability to execute programmed instructions, receive input from various sensors, and communicate with one or more internal or external event capture devices 20 and other external devices (not shown). An example general purpose computing device that may be employed as all or a portion of an event detector 30 is later described with respect to FIG. 11. An example general purpose wireless communication device that may be employed as all or a portion of an event detector 30 is later described with respect to FIG. 10.

When the event detector 30 identifies an event, the event detector 30 instructs the one or more event capture devices 20 to record pre-event data, during the event data, and post-event data that is then provided to the event detector 30 and stored in the data storage area 35. Events may comprise a variety of situations, including automobile accidents, reckless driving, rough driving, or any other type of stationary or moving occurrence that the owner of a vehicle 10 may desire to know about.

The vehicle 10 may have a plurality of event capture devices placed in various locations around the vehicle 10. An event capture device 20 may comprise a video camera, still camera, microphone, and other types of data capture devices. For example, an event capture device 20 may include an accelerometer that senses changes in speed or direction. Additional sensors and/or data capture devices may also be incorporated into an event capture device 20 in order to provide a rich set of information about a detected event.

The data storage area 35 can be any sort of internal or external, fixed or removable memory device and may include both persistent and volatile memories. The function of the data storage area 35 is to maintain data for long term storage and also to provide efficient and fast access to instructions for applications or modules that are executed by the event capture device 30.

In one embodiment, event detector 30 in combination with the one or more event capture devices 20 identifies an event and stores certain audio and video data along with related information about the event. For example, related information may include the speed of the vehicle when the event occurred, the direction the vehicle was traveling, the location of the vehicle (e.g., from a global positioning system ("GPS") sensor), and other information from sensors located in and around the vehicle or from the vehicle itself (e.g., from a data bus integral to the vehicle such as an on board diagnostic ("OBD") vehicle bus). This combination of audio, video, and other data is compiled into an event that can be stored in data storage 35 onboard the vehicle for later delivery to an evaluation server.

Figure 2:
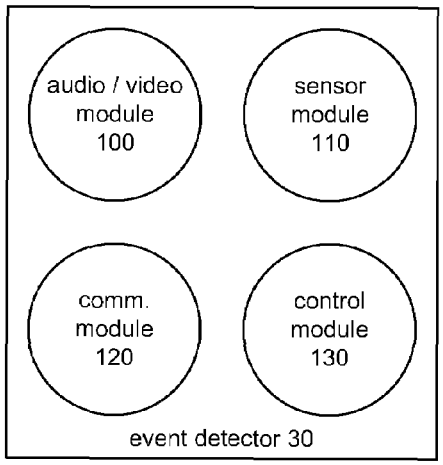
FIG. 2 is a block diagram illustrating an example event detector according to an embodiment of the present invention.

FIG. 2 is a block diagram illustrating an example event detector 30 according to an embodiment of the present invention. In the illustrated embodiment, the event detector 30 comprises an audio/video ("AV") module 100, a sensor module 110, a communication module 120, and a control module 130. Additional modules may also be employed to carry out the various functions of the event detector 30, as will be understood by those having skill in the art.

The AV module 100 is configured to manage the audio and video input from one or more event capture devices and storage of the audio and video input. The sensor module 110 is configured to manage one or more sensors that can be integral to the event detector 30 or external from the event detector 30. For example, an accelerometer may be integral to the event detector 30 or it may be located elsewhere in the vehicle. The sensor module 110 may also manage other types of sensor devices such as a GPS sensor, temperature sensor, moisture sensor, or the like (all not shown).

The communication module 120 is configured to manage communications between the event detector 30 and other devices and modules. For example, the communication module 120 may handle communications between the event detector 30 and the various event capture devices 20. The communication module 120 may also handle communications between the event detector 30 and a memory device, a docking station, or a server such as an evaluation server. The communication module 120 is configured to communicate with these various types of devices and other types of devices via a direct wire link (e.g., USB cable, firewire cable), a direct wireless link (e.g., infrared, Bluetooth, ZigBee), or a wired or any wireless network link such as a local area network ("LAN"), a wide area network ("WAN"), a wireless wide area network ("WWAN"), an IEEE 802 wireless network such as an IEEE 802.16 ("WiFi") network, a WiMAX network, satellite network, or a cellular network.

The control module 130 is configured to control the actions or remote devices such as the one or more event capture devices. For example, the control module 130 may be configured to instruct the event capture devices to capture an event and return the data to the event detector when it is informed by the sensor module 110 that certain trigger criteria have been met that identify an event.

Figure 3:
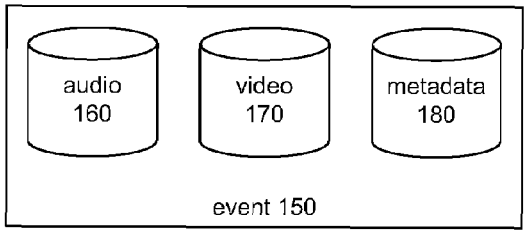
FIG. 3 is a block diagram illustrating an example event according to an embodiment of the present invention.

FIG. 3 is a block diagram illustrating an example event 150 according to an embodiment of the present invention. In the illustrated embodiment, the event 150 comprises audio data 160, video data 170, and metadata 180. The audio data 160 can be collected from inside the vehicle, outside the vehicle, and may include information from an internal vehicle bus about the baseline noise level of the operating vehicle, if such information is available. Additional information about baseline noise level, radio noise level, conversation noise level, or external noise level may also be included in audio data 160.

Video data 170 may include still images or moving video captured by one or more cameras in various locations in and around the vehicle. Video data 170 may include images or video from inside the vehicle, outside the vehicle, or both. In one particularly advantageous embodiment, still images and moving video that illustrate the entire area inside the vehicle and the entire 360 degree area surrounding the vehicle are captured by a plurality of image capture devices and included in video data 170.

Meta data 180 may include a variety of additional information that is available to the event detector 30 at the time of an event. Such additional data may include, but is not limited to, the velocity and direction of the vehicle, the GPS location of the vehicle, elevation, time, temperature, and vehicle engine and electrical component information, status of vehicle lights and signals, brake operation and position, throttle position, etc. captured from an internal vehicle bus, just to name a few. Additional information may also be included such as the number of occupants in the vehicle, whether seatbelts were fastened, whether airbags deployed, whether evasive maneuvering was attempted as determined by the route of the vehicle prior to the event. The specific identification of the driver may also be included, for example as read by the event detector from a radio frequency identification ("RFID") badge worn by the driver or integrated with a vehicle key assigned to the driver. As will be understood by those skilled in the art, meta data 180 may include an extremely rich variety of information limited only by the scope and type of information obtained prior to, during, and after an event.

Figure 4:
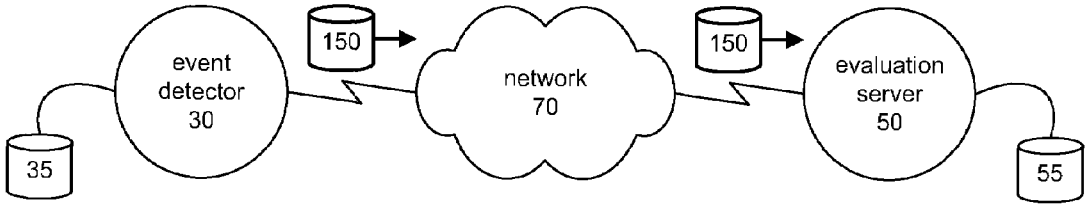
FIG. 4 is a block diagram illustrating an example event traveling from an event detector to an evaluation server according to an embodiment of the present invention.

FIG. 4 is a block diagram illustrating an example event 150 traveling from an event detector 30 to an evaluation server 50 according to an embodiment of the present invention. In one embodiment, events such as event 150 are captured by an event detector 30 and stored locally until they are provided to the evaluation server 50. The means by which an event 150 can be provided to the evaluation server 50 can vary. In various embodiments (or in a single embodiment), an event 150 may be provided from event detector 30 to evaluation server 50 by way of a portable media device, a direct wire link, a direct wireless link, an indirect wire link, an indirect wireless link, or any combination of these. Event 150 may be secured by encryption of the event 150 data structure and/or a secure channel between the event detector 30 and the evaluation server 50.

For example, a portable media device may include a USB drive, compact disc, thumb drive, media card, or other similar type of device. A direct wire link may include a USB cable, a firewire cable, an RS-232 cable, or the like. A direct wireless link may include an infrared link, a Bluetooth link, ZigBee link, or an IEEE 802.11 point-to-point link, a WiMAX link, or a cellular link, just to name a few. An indirect wired link may include a packet switched or circuit switched network connection configured for conveyance of data traffic. An Ethernet network connection is an example of a packet switched indirect wired link and a dial up modem connection is an example of a circuit switched indirect wired link, both of which may be configured for conveyance of data traffic.

In the illustrated embodiment of FIG. 4, the event 150 travels over a network 70 from the event detector 30 to the evaluation server 50. The network 70 may comprise any of a variety of network types and topologies and any combination of such types and topologies. For example, the network 70 may comprise a plurality of networks including private, public, wired, wireless, circuit switched, packet switched, personal area networks ("PAN"), local area networks ("LAN"), wide area networks ("WAN"), metropolitan area networks ("MAN"), satellite networks, or any combination of the these. Network 70 may also include that particular combination of networks ubiquitously known as the Internet.

In one embodiment, network 70 may be a wireless network. In such an embodiment, the network 70 may be accessed by way of one or more access points (not shown) that provide access to network 70 via many different wireless networking protocols as will be well understood by those having skill in the art. The wireless network 70 may be a WWAN, a WiFi network, a WiMAX network, a cellular network, satellite network, or other type of wireless network that employs any variety of wireless network technology.

Figure 5:
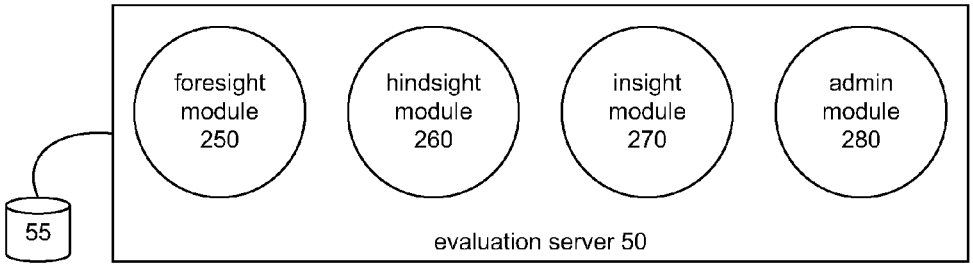
FIG. 5 is a block diagram illustrating an example evaluation server according to an embodiment of the present invention.

FIG. 5 is a block diagram illustrating an example evaluation server 50 according to an embodiment of the present invention. In the illustrated embodiment, the evaluation server 50 comprises a foresight module 250, a hindsight module 260, an insight module 270, and an administrative module 280.

The foresight module 250 is configured to monitor individual driver behavior and objectively score that behavior. The driver score is provided to executives and managers who can use that information to make informed decisions about behavior modification to eliminate or reduce risky behavior of an individual driver. Advantageously, reducing or eliminating risky behavior of a fleet of drivers may have a significant effect on the cost of insurance for the owner of the fleet of vehicles being driven.

The hindsight module 260 is configured to capture and store event data related to accidents, crashes, and other serious driving events in order to document for use by law enforcement in forensic analysis and insurance companies in coverage disputes. Advantageously, the captured event information provides a purely objective reconstruction of what happened prior to, during, and after an event.

The insight module 270 is configured to aggregate event data into a database of driving events and correlate information in the database to identify trends in driving behavior that relate to risk factors. For example, information about the vehicle and its various components, the driver and occupants, the driving conditions, the driving environment, and other useful data can be employed. The insight module 270 is additionally configured to correlate cause and effect relationships between data points and determine the effect of those relationships upon driver safety. The insight module 270 additionally compares these correlations and driver safety trends with historical event information for individual drivers to provide a driver rating or driver score for an individual driver. The driver score can be used by insurance companies to establish individualized insurance rates.

Figure 6:
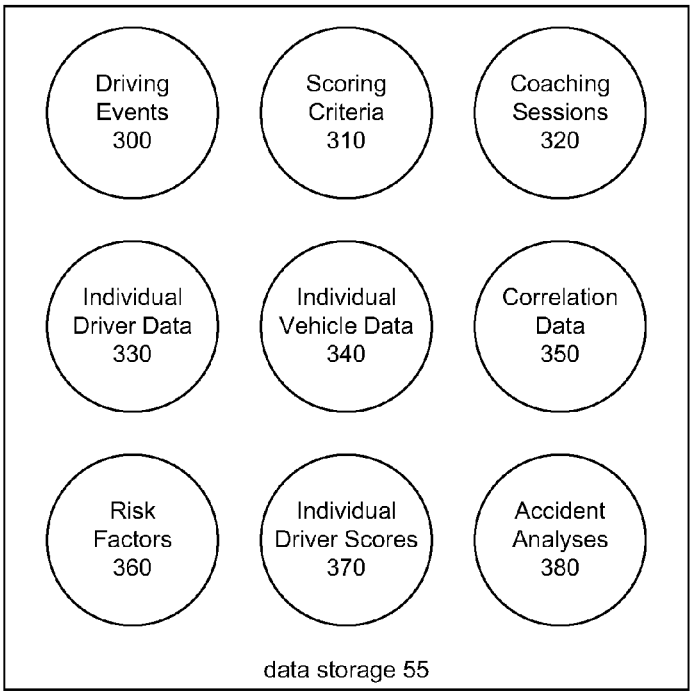
FIG. 6 is a block diagram illustrating an example data storage area for aggregating event data and related data according to an embodiment of the present invention.

FIG. 6 is a block diagram illustrating an example data storage area 55 for aggregating event data and related data according to an embodiment of the present invention. In the illustrated embodiment, the data storage area 55 comprises data for driving events 300, scoring criteria 310, counseling sessions 320, individual driver data 330, individual vehicle data 340, correlation data 350, risk factors 360, individual driver scores 370, and accident analysis 380.

The data in data storage area 55 may be formatted in a variety of ways, including tables, flat files, databases, or relational databases. Alternative data organizations for efficiently storing information related to driving events and identifying correlations and causal relationships between data points may also be employed.

In one embodiment, driving events 300 may include, but are not limited to audio, video, and metadata related to specific events. The metadata may include, but is not limited to, the speed of the vehicle when the event occurred, the direction the vehicle was traveling, the forces operating on the vehicle when the event occurred, the location of the vehicle (e.g., from GPS or triangulation), information from sensors located in and around the vehicle, and vehicle status information from an OBD vehicle bus.

In one embodiment, scoring criteria 310 may include, but are not limited to values, parameters, formulas and other information used to score an event, a driver, or a vehicle. For example, the speed and direction of the vehicle can be used as a scoring criteria in combination with the type of road or highway the vehicle was on, e.g., as determined by the location of the vehicle. Additionally criteria may include the number of passengers in the vehicle, the type of vehicle, vehicle status information from the OBD vehicle bus, weather conditions, and demographic information about the driver and vehicle, just to name a few.

In one embodiment, counseling sessions 320 may include, but are not limited to audio, video, and metadata compiled as a result of an analysis of one or more driving events. A counseling session may be prepared for an individual driver or a group of drivers (e.g., night shift drivers). For example, counseling sessions can be reviewed by drivers, managers, new hires, or the like in order to counsel individual drivers, groups of drivers, or provide information to managers and executives.

In one embodiment, individual driver data 330 may include, but is not limited to demographic information about the driver and events for that driver. The demographic information may include the age and gender of the driver, any driving related limitations such as eyesight or height, past driving record information (both work related and personal), past driving insurance information (both work related and personal), individual counseling sessions prepared for the driver, group counseling sessions viewed by the driver, and other information related to the driver.

In one embodiment, individual vehicle data 340 may include, but is not limited to demographic information about the vehicle including its make, model, vehicle identification number ("VIN") and crash test results. Vehicle data 340 may also include mileage of the vehicle, maintenance records, the type of tires on the vehicle, when the tires were last replaced or rotated, and when the vehicle is next due for an oil change or other service, just to name a few. Additionally, a summary of event data for the vehicle type may be included as well as actual event data for the specific vehicle. Other types of vehicle related data may also be included, as will be understood by one having skill in the art.

In one embodiment, correlation data 350 may include, but is not limited to information about correlations between events and the circumstances and conditions surrounding the event, including driver data and vehicle data. For example, correlation data 350 may include information about the weather conditions during which an event occurred and the relationship (if any) between the weather conditions and the event. Additionally, correlation data 350 may include links between particular known vehicle defects and types of events that may be caused by such defects. Additional correlation data 350 may also be included that advantageously represents relationships (causal or not) between events and the surrounding circumstances.

In one embodiment, risk factors 360 may include, but are not limited to information about risk factors related to the conditions, driver, vehicle, and other factors surrounding an event. For example, risk factors 360 may include a threshold driver score that identifies any driver with a score lower than the threshold as a certain degree of risk factor in any event that occurs. There may be more than one threshold with varying degrees of risk associated with each threshold. Similar identifications or assignment of degrees of risk may also be included and associated with the vehicle (either the general category of vehicle or the specific vehicle) and the vehicle maintenance record, for example. Other risk factors can also be assigned particular conditions that may be related to an individual event.

In one embodiment, individual driver scores 370 may include, but are not limited to results of scoring criteria and risk factors applied to individual drivers. For example, historical event data for an individual driver may be compiled and analyzed in view of the scores of the events, risk factors identified for the events, vehicle data and historical scores for the vehicles involved in the events, and the driving record of the individual. Additional information may also be analyzed in combination with correlation data and risk factors in order to calculate an individual driver score that is stored with driver scores 370. Advantageously, driver scores 370 may be recalculated over time and a historical driver score graph may be provided. Such information (an current driver score or a historical driver score graph) can be provided to insurance carriers or providers in order to write individually tailored insurance policies.

Additionally, individual scores may also be calculated for specific vehicles (e.g., by VIN number), makes and models of vehicles, and classes of vehicles. These individual vehicle scores may also be stored in data storage area 55. Advantageously, this information may also be included in the calculation of an individual driver score, based on the type of vehicle(s) or the specific vehicle(s) (e.g., by VIN number) that the individual owns and/or drives.

In one embodiment, accident analyses 380 may include, but are not limited to reports based on the forensic analysis of particular events and audio and video reconstructions of the specific event. For example, the event data for an automobile accident may be analyzed to objectively reconstruct what happened during an accident. That data, including AV data, vehicle status (e.g., were the brakes applied, and when), vehicle location over time (e.g., tracking a vehicle skid), number of occupants in the vehicle, etc. can be used to create an audio and video reconstruction of the accident with critical event data overlaid on the video portion in order to identify important aspects of the reconstruction. Such accident analyses 380 may advantageously be used during disputes after the accident, for example, litigation between the drivers of the vehicles involved in the accident or in a dispute with an insurance company over who is responsible and/or should pay damages related to the accident. Additional uses of the accident analyses 380 may also be employed, as will be understood by one having skill in the art.

Figure 7:
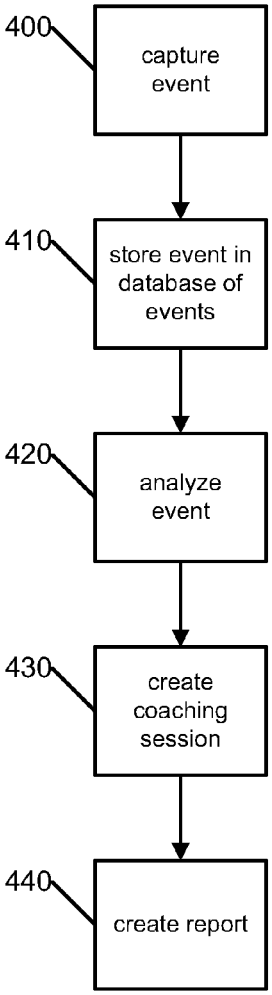
FIG. 7 is a flow diagram illustrating an example process for providing driver counseling sessions and reports according to an embodiment of the present invention.

FIG. 7 is a flow diagram illustrating an example foresight process for providing driver counseling sessions and reports according to an embodiment of the present invention. This process may be carried out by a system such as that previously described with respect to FIG. 4. Initially, in step 400 an event capture device captures an event. The event is a data structure that includes AV data and metadata related to the occurrence that is the subject matter of the event.

After the event has been captured, it is stored in a database of events, as shown in step 410. In one embodiment, the database of events is remote from the event capture device and accordingly the event is transmitted from the event capture device to a server or other controller of the database of events. The transmission of the event data may occur by a direct wired or wireless link or by an indirect wired or wireless link. For example, a USB cable, Bluetooth, ZigBee, WAN, satellite, or WiFi connection can be used to transmit the event for storage in the database of events.

Once the event is in the database of events, in step 420 the event is analyzed by an operator. The operator may be local or remote and can access events on an evaluation server at an analysis station that is communicatively coupled with the evaluation server via a data network. The operator may analyze events individually or in groups. In one embodiment, an operator may analyze all events for a particular driver at the end of each day, week, or month. The analysis of the event advantageously includes a review of what happened and a characterization of the event, for example indicating that the event should be reviewed by the individual driver, by his supervisor, by a manager, by an executive, by police, or the like.

After the analysis is complete, in step 430 the operator performing the analysis or a counselor may create a counseling session for the driver. The counseling session may include information from multiple events along with certain metadata information that is relevant, important, or critical to the event and the driver's understanding of the event. For example, the counseling session may be a video clip that includes audio and other visual information (e.g., text and graphs) that are overlaid on the video data for the event. Thus, by watching the counseling session, the driver may be able to see from the multiple points of view of multiple on board event capture devices what happened leading up to, during, and after the event. Certain information such as, for example, the speed of the vehicle and at what precise point in time the brakes were applied, may also be displayed as the video plays in the background. Counseling session may be created for individual drivers, groups of drivers, or other audiences.

Next, in step 440, a report is created. This report can be created for the employer, for the driver, or for another audience. The report may also be created before, at the same time as, or after the counseling session and may be created by the same person or by another. Additionally, summary reports may also be created that summarize all event data for a certain shift, day, week, month or other time period. Summary reports can be provided based on individual or group event data.

Figure 8:
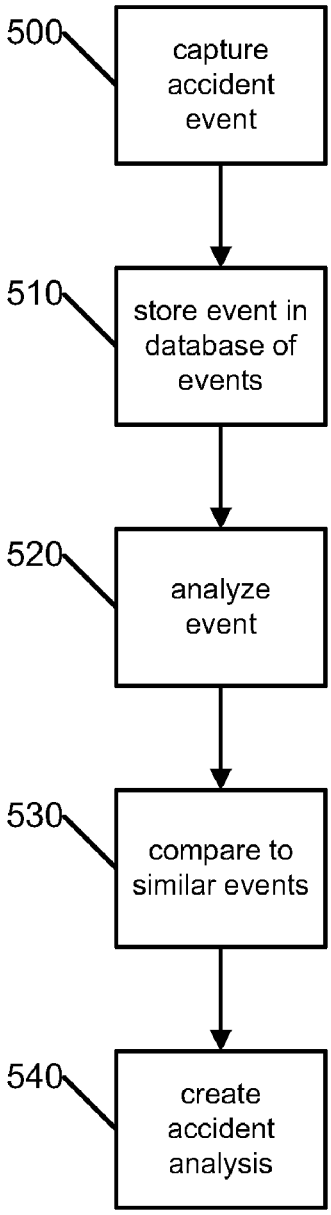
FIG. 8 is a flow diagram illustrating an example process for providing forensic analysis of an automobile accident according to an embodiment of the present invention.

FIG. 8 is a flow diagram illustrating an example hindsight process for providing forensic analysis of an automobile accident according to an embodiment of the present invention. This process may be carried out by a system such as that previously described with respect to FIG. 4. Initially, in step 500 an event capture device captures the automobile accident as an event. The automobile accident event is a data structure that includes AV data and metadata related to the automobile accident.

After the event has been captured, it is stored in a database of events, as shown in step 510. In one embodiment, the database of events the database of events can be managed by an evaluation server and can be remote from the event capture device. Accordingly, the event is transmitted from the event capture device to the evaluation server or other controller of the database of events. The transmission of the event data may occur by a direct wired or wireless link or by an indirect wired or wireless link. For example, a USB cable, Bluetooth, ZigBee, WAN, satellite, or WiFi connection can be used to transmit the event for storage in the database of events.

Once the event is in the database of events, in step 520 the event is analyzed by an operator. The operator may be a forensic analyst, an insurance company employee, a police officer, a private investigator, or the like. The operator may be local or remote and can access the event on the evaluation server from an analysis station that is communicatively coupled with the evaluation server via a data network. The analysis of the event may advantageously include a review of what happened leading up to, during, and after the automobile accident. This information can then be compared to similar types of events, as illustrated in step 530, in order to make assumptions and conclusions about the causal relationships between the circumstances surrounding the automobile accident and the accident itself.

After the analysis is complete, the operator may determine the likely cause of the accident (if plausible). Alternatively, the operator may determine that the cause of the accident is unknown. In either case, in step 540 the operator summarizes the analysis related to the automobile accident in an accident analysis. The accident analysis can include AV data along with additional information, for example text and graphs that provide information related to the accident, for example, the speed and direction of the vehicle, its location, etc. The accident analysis can be stored at the evaluation server and can also be provided to third parties as a fee based service or as a one time sale.

Figure 9:
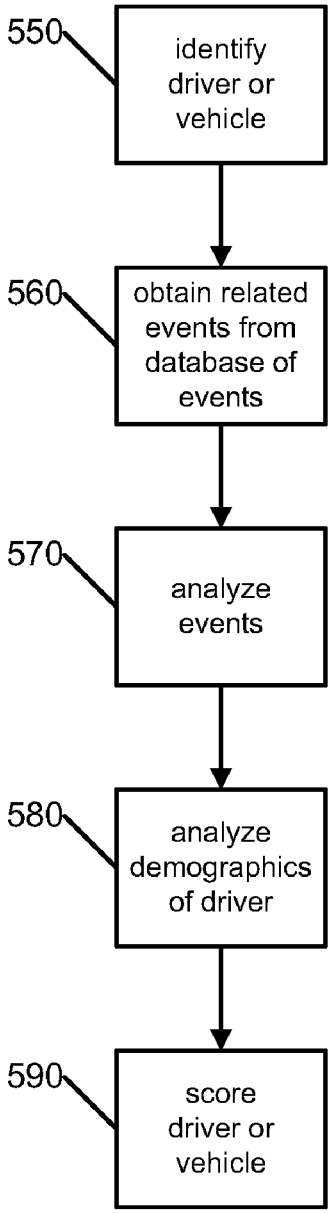
FIG. 9 is a flow diagram illustrating an example process for creating a driver or vehicle score according to an embodiment of the present invention.

FIG. 9 is a flow diagram illustrating an example insight process for creating a driver or vehicle score according to an embodiment of the present invention. This process may be carried out by a system such as that previously described with respect to FIG. 4. Initially, in step 550, a driver or vehicle (or group of drivers or vehicles) is identified. The driver(s) or vehicle(s) is the subject of the scoring process. For simplicity, the process will be described with respect to scoring an individual driver, however the process may be used to score an individual driver, a group of drivers (e.g., a family or employees), an individual vehicle (e.g., identified by VIN), or a group of vehicles, a make of vehicles, a class of vehicles (e.g., light truck), or other, as will be understood by those having skill in the art.

Once the individual driver is identified, in step 560 the database of events is searched or queried to obtain event data related to the individual driver. Advantageously, a historical collection of events can be obtained from an evaluation server that maintains a database of events and these events can then be analyzed in step 570. The analysis of the events may include review of AV data and metadata for an event in view of certain scoring criteria, correlation data, and risk factors. Additionally, as part of the overall analysis, demographic information can also be analyzed, as shown in step 580. The demographic information may include the driver's age, gender, residence, and other related information. For a vehicle such information may include mileage, service history and the like.

After the events and the related demographic information have been analyzed, in step 590 an objective score for the individual driver can be calculated. This driver score can advantageously be used in the determination of an appropriate insurance cost for the driver. Additionally, historical information about an individual's driver score can also be used to assist with the determination of trends in driver safety or risk factors, for example, a driver with a decade long trend of decreasing driver scores may be qualify for a lower insurance rate than a driver with a decade long trend of increasing driver scores, even though the two individuals have equal driver scores. Additional advantages and uses of driver scores will be understood by those having skill in the art.

Figure 10:
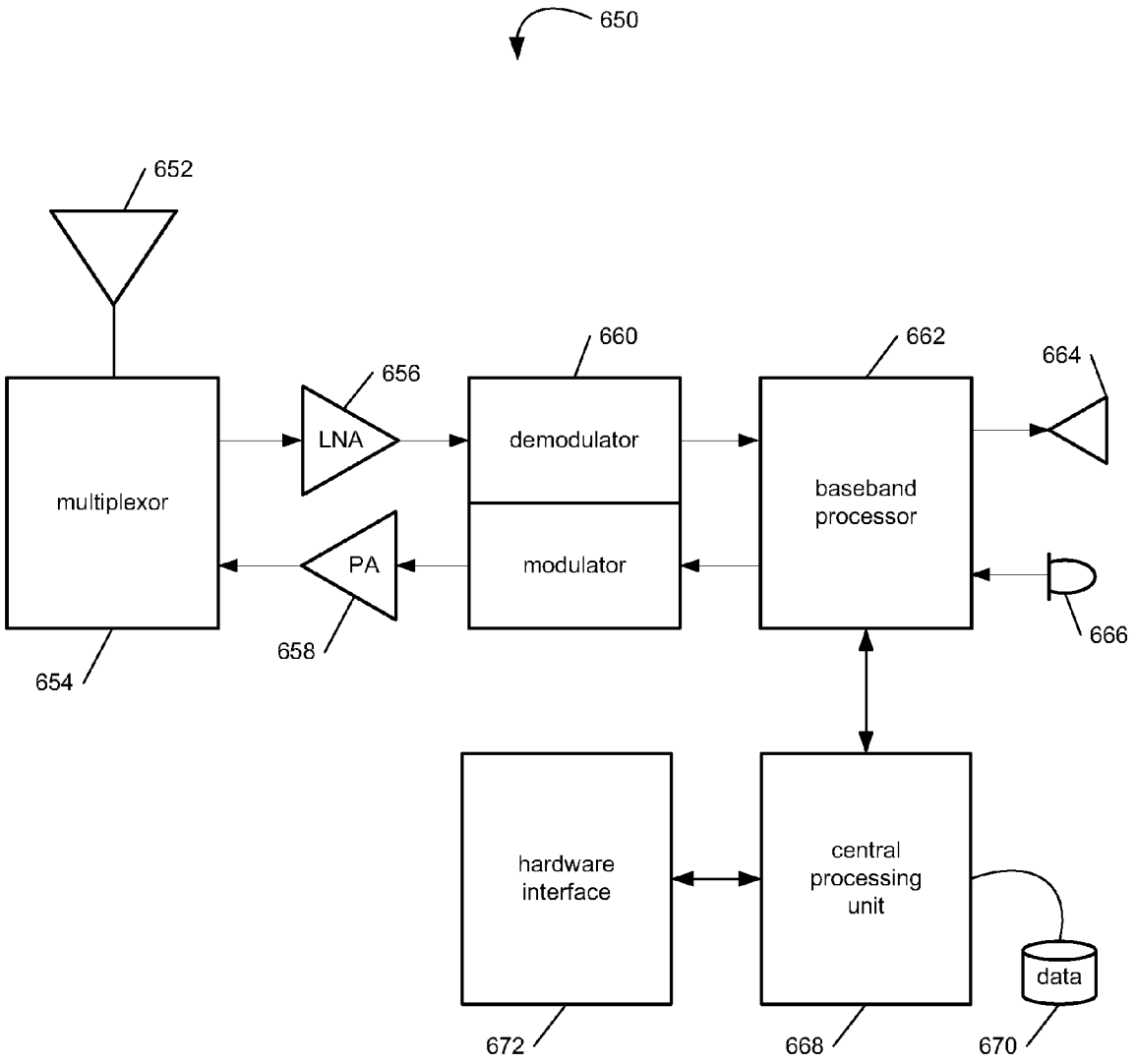
FIG. 10 is a block diagram illustrating an exemplary wireless communication device that may be used in connection with the various embodiments described herein.

FIG. 10 is a block diagram illustrating an exemplary wireless communication device 650 that may be used in connection with the various embodiments described herein. For example, the wireless communication device 650 may be used in conjunction with an event detector previously described with respect to FIG. 1, or an evaluation server, analysis station, counseling station, or supervisor station previously described with respect to FIG. 2. However, other wireless communication devices and/or architectures may also be used, as will be clear to those skilled in the art.

In the illustrated embodiment, wireless communication device 650 comprises an antenna 652, a multiplexor 654, a low noise amplifier ("LNA") 656, a power amplifier ("PA") 658, a modulation circuit 660, a baseband processor 662, a speaker 664, a microphone 666, a central processing unit ("CPU") 668, a data storage area 670, and a hardware interface 672. In the wireless communication device 650, radio frequency ("RF") signals are transmitted and received by antenna 652. Multiplexor 654 acts as a switch, coupling antenna 652 between the transmit and receive signal paths. In the receive path, received RF signals are coupled from a multiplexor 654 to LNA 656. LNA 656 amplifies the received RF signal and couples the amplified signal to a demodulation portion of the modulation circuit 660.

Typically modulation circuit 660 will combine a demodulator and modulator in one integrated circuit ("IC"). The demodulator and modulator can also be separate components. The demodulator strips away the RF carrier signal leaving a base-band receive audio signal, which is sent from the demodulator output to the base-band processor 662.

If the base-band receive audio signal contains audio information, then base-band processor 662 decodes the signal and converts it to an analog signal. Then the signal is amplified and sent to the speaker 664. The base-band processor 662 also receives analog audio signals from the microphone 666. These analog audio signals are converted to digital signals and encoded by the base-band processor 662. The base-band processor 662 also codes the digital signals for transmission and generates a base-band transmit audio signal that is routed to the modulator portion of modulation circuit 660. The modulator mixes the base-band transmit audio signal with an RF carrier signal generating an RF transmit signal that is routed to the power amplifier 658. The power amplifier 658 amplifies the RF transmit signal and routes it to the multiplexor 654 where the signal is switched to the antenna port for transmission by antenna 652.

The baseband processor 662 is also communicatively coupled with the central processing unit 668. The central processing unit 668 has access to a data storage area 670. The central processing unit 668 is preferably configured to execute instructions (i.e., computer programs or software) that can be stored in the data storage area 670. Computer programs can also be received from the baseband processor 662 and stored in the data storage area 670 or executed upon receipt. Such computer programs, when executed, enable the wireless communication device 650 to perform the various functions of the present invention as previously described.

In this description, the term "computer readable medium" is used to refer to any media used to provide executable instructions (e.g., software and computer programs) to the wireless communication device 650 for execution by the central processing unit 668. Examples of these media include the data storage area 670, microphone 666 (via the baseband processor 662), antenna 652 (also via the baseband processor 662), and hardware interface 672. These computer readable mediums are means for providing executable code, programming instructions, and software to the wireless communication device 650. The executable code, programming instructions, and software, when executed by the central processing unit 668, preferably cause the central processing unit 668 to perform the inventive features and functions previously described herein.

The central processing unit is also preferably configured to receive notifications from the hardware interface 672 when new devices are detected by the hardware interface. Hardware interface 672 can be a combination electromechanical detector with controlling software that communicates with the CPU 668 and interacts with new devices.

Figure 11:
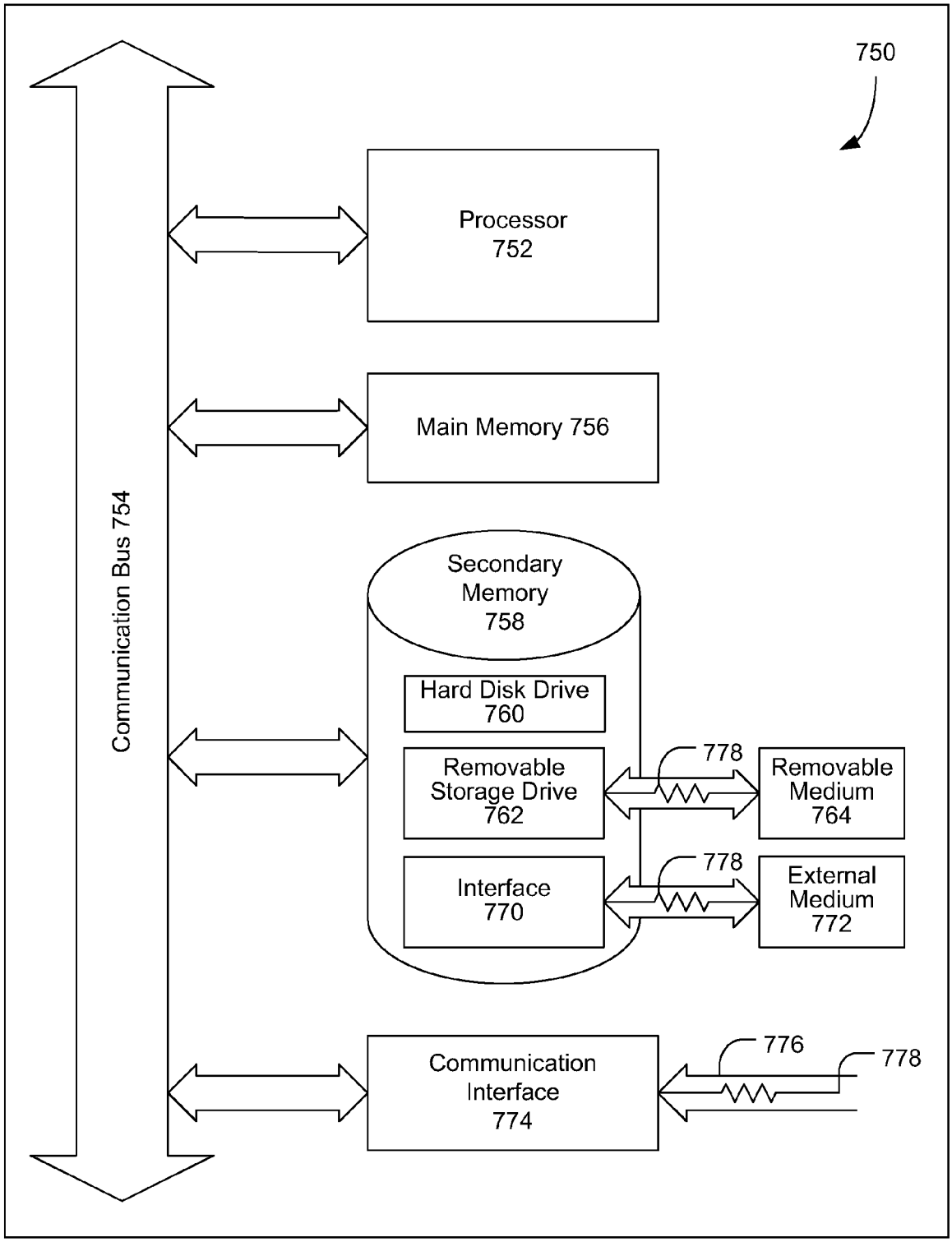
FIG. 11 is a block diagram illustrating an exemplary computer system as may be used in connection with various embodiments described herein.

FIG. 11 is a block diagram illustrating an exemplary computer system 750 that may be used in connection with the various embodiments described herein. For example, the computer system 750 may be used in conjunction with an event detector previously described with respect to FIG. 1, or an evaluation server, analysis station, counseling station, or supervisor station previously described with respect to FIG. 2. However, other computer systems and/or architectures may be used, as will be clear to those skilled in the art.

The computer system 750 preferably includes one or more processors, such as processor 752. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with the processor 752.

The processor 752 is preferably connected to a communication bus 754. The communication bus 754 may include a data channel for facilitating information transfer between storage and other peripheral components of the computer system 750. The communication bus 754 further may provide a set of signals used for communication with the processor 752, including a data bus, address bus, and control bus (not shown). The communication bus 754 may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, mini PCI express, or standards promulgated by the Institute of Electrical and Electronics Engineers ("IEEE") including IEEE 488 general-purpose interface bus ("GPIB"), IEEE 696/S-100, and the like.

Computer system 750 preferably includes a main memory 756 and may also include a secondary memory 758. The main memory 756 provides storage of instructions and data for programs executing on the processor 752. The main memory 756 is typically semiconductor-based memory such as dynamic random access memory ("DRAM") and/or static random access memory ("SRAM"). Other semiconductor-based memory types include, for example, synchronous dynamic random access memory ("SDRAM"), Rambus dynamic random access memory ("RDRAM"), ferroelectric random access memory ("FRAM"), and the like, including read only memory ("ROM").

The secondary memory 758 may optionally include a hard disk drive 760 and/or a removable storage drive 762, for example a floppy disk drive, a magnetic tape drive, a compact disc ("CD") drive, a digital versatile disc ("DVD") drive, etc. The removable storage drive 762 reads from and/or writes to a removable storage medium 764 in a well-known manner. Removable storage medium 764 may be, for example, a floppy disk, magnetic tape, CD, DVD, memory stick, USB memory device, etc.

The removable storage medium 764 is preferably a computer readable medium having stored thereon computer executable code (i.e., software) and/or data. The computer software or data stored on the removable storage medium 764 is read into the computer system 750 as electrical communication signals 778.

In alternative embodiments, secondary memory 758 may include other similar means for allowing computer programs or other data or instructions to be loaded into the computer system 750. Such means may include, for example, an external storage medium 772 and an interface 770. Examples of external storage medium 772 may include an external hard disk drive or an external optical drive, or and external magneto-optical drive.

Other examples of secondary memory 758 may include semiconductor-based memory such as programmable read-only memory ("PROM"), erasable programmable read-only memory ("EPROM"), electrically erasable read-only memory ("EEPROM"), or flash memory. Also included are any other removable storage units 772 and interfaces 770, which allow software and data to be transferred from the removable storage unit 772 to the computer system 750.

Computer system 750 may also include a communication interface 774. The communication interface 774 allows software and data to be transferred between computer system 750 and external devices (e.g. printers), networks, or information sources. For example, computer software or executable code may be transferred to computer system 750 from a network server via communication interface 774. Examples of communication interface 774 include a modem, a network interface card ("NIC"), a communications port, a PCMCIA slot and card, an infrared interface, and an IEEE 1394 fire-wire, just to name a few.

Communication interface 774 preferably implements industry promulgated protocol standards, such as Ethernet IEEE 802 standards, Fiber Channel, digital subscriber line ("DSL"), asynchronous digital subscriber line ("ADSL"), frame relay, asynchronous transfer mode ("ATM"), integrated digital services network ("ISDN"), personal communications services ("PCS"), transmission control protocol/Internet protocol ("TCP/IP"), serial line Internet protocol/point to point protocol ("SLIP/PPP"), and so on, but may also implement customized or non-standard interface protocols as well.

Software and data transferred via communication interface 774 are generally in the form of electrical communication signals 778. These signals 778 are preferably provided to communication interface 774 via a communication channel 776. Communication channel 776 carries signals 778 and can be implemented using a variety of wired or wireless communication means including wire or cable, fiber optics, conventional phone line, cellular phone link, wireless data communication link, radio frequency (RF) link, or infrared link, just to name a few.

Computer executable code (i.e., computer programs or software) is stored in the main memory 756 and/or the secondary memory 758. Computer programs can also be received via communication interface 774 and stored in the main memory 756 and/or the secondary memory 758. Such computer programs, when executed, enable the computer system 750 to perform the various functions of the present invention as previously described.

In this description, the term "computer readable medium" is used to refer to any media used to provide computer executable code (e.g., software and computer programs) to the computer system 750. Examples of these media include main memory 756, secondary memory 758 (including hard disk drive 760, removable storage medium 764, and external storage medium 772), and any peripheral device communicatively coupled with communication interface 774 (including a network information server or other network device). These computer readable mediums are means for providing executable code, programming instructions, and software to the computer system 750.

In an embodiment that is implemented using software, the software may be stored on a computer readable medium and loaded into computer system 750 by way of removable storage drive 762, interface 770, or communication interface 774. In such an embodiment, the software is loaded into the computer system 750 in the form of electrical communication signals 778. The software, when executed by the processor 752, preferably causes the processor 752 to perform the inventive features and functions previously described herein.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A method for reducing risk in driving, comprising:

capturing a driving event at an event detector coupled with a vehicle, the driving event comprising profile information including an identifier that identifies the driver of the vehicle during the driving event, said captured driving event further comprising video data recorded of the inside of the vehicle and of the outside of the vehicle;

providing the driving event to an evaluation server;

storing the driving event in a database managed by the evaluation server;

associating the driving event with a driver record stored in said database, wherein the driver record comprises the identifier that identifies the driver;

analyzing the driving event to calculate a driving event score;

associating the driving event score with said driver record in the database;

creating a driver counseling session based on the driving event;

associating the driver counseling session with said driver record in the database; and combining a plurality of driving event scores associated with a driver identifier to generate a driver score.

2. The method of claim 1, wherein the driving event further comprises audio data.

3. The method of claim 1, wherein the video data is captured from two or more event capture devices communicatively coupled with the event detector.

4. The method of claim 1, wherein the driving event further comprises metadata.

5. A method for reducing risk in driving, comprising:

capturing a driving event at an event detector coupled with a vehicle, the driving event comprising audio data, video data of the inside of the vehicle and the outside of the vehicle, and metadata collected before, during, and after the event;

providing the driving event to an evaluation server;

storing the driving event in a database managed by the evaluation server;

analyzing the driving event to identify an initial likely cause of the event;

comparing the driving event to a plurality of other driving events to identify a refined likely cause of the event; and reviewing the initial likely cause of the event and the refined likely cause of the event to identify a probably cause of the event.

6. The method of claim 5, wherein the data comprising the driving event is captured from two or more event capture devices communicatively coupled with the event detector.

7. The method of claim 5, wherein the driving event is provided to the evaluation server via a data network.

8. The method of claim 7, wherein the data network is a wired network.

9. The method of claim 7, wherein the data network is a wireless network.

10. The method of claim 7, wherein the data network is a combination wired and wireless network.

11. The method of claim 5, wherein the driving event is provided to the evaluation server via a direct communication link.

12. The method of claim 11, wherein the direct communication link is wired link.

13. The method of claim 11, wherein the direct communication link is wireless link.

14. A method for reducing risk in driving, comprising:

identifying an individual driver;

obtaining a plurality of driving events for the individual driver, the driving events obtained from a data storage area comprising a plurality of driving events for a plurality of drivers, said driving events including recorded video data of the inside of the vehicle and the outside of the vehicle prior to during and after the driving event;

analyzing the plurality of driving events for the individual driver;

analyzing demographic data for the individual driver, said demographic data obtained from a data storage area comprising a plurality of driver records, said records comprising demographic data; and scoring the individual driver based on the analysis of the plurality of driving events and the analysis of the demographic data.

15. A system for reducing risk in driving, comprising:

an event detector coupled with a vehicle, the event detector configured to capture a driving event in response to a trigger, the driving event comprising profile information including an identifier that identifies the driver of the vehicle during the driving event said driving event further including recorded video data of the inside of the vehicle and the outside of the vehicle;

a communication link configured to convey the driving event from the event detector to an evaluation server;

an evaluation server comprising a plurality of analysis modules, each analysis module configured to analyze a plurality of driving events and provide responsive analysis information; and a data storage area coupled with the evaluation server, the data storage area configured to store driving events, scoring criteria, coaching sessions, individual driver data, individual vehicle data, correlation data, risk factor data, accident analysis data, driver scoring data, and vehicle scoring data.

16. The system of claim 15, wherein the communication link is a wired network.

17. The system of claim 16, wherein the wired network comprises a private network.

18. The system of claim 16, wherein the wired network comprises a public network.

19. The system of claim 15, wherein the communication link is a wireless network.

20. The system of claim 19, wherein the wireless network comprises a ZigBee link.

21. The system of claim 19, wherein the wireless network comprises a Bluetooth link.

22. The system of claim 15, wherein the plurality of analysis modules comprises a foresight module configured to analyze driving event data and create a coaching session comprising information related to reducing risky driving behavior.

23. The system of claim 15, wherein the plurality of analysis modules comprises a hindsight module configured to analyze driving event data related to a vehicle accident and create a forensic analysis comprising information related to a cause of the vehicle accident.

24. The system of claim 15, wherein the plurality of analysis modules comprises an insight module configured to analyze driving event data and create an individual driver score based upon historical driving event data for an individual driver.

* * * * *

US007659827C1

(12) INTER PARTES REEXAMINATION CERTIFICATE (632nd)

United States Patent

Gunderson et al.

(10) Number: US 7,659,827 C1

(45) Certificate Issued: Jul. 8, 2013

(54) SYSTEM AND METHOD FOR TAKING RISK OUT OF DRIVING

(75) Inventors: Charlie Gunderson, La Jolla, CA (US); Tom Lefleur, Rancho Sante Fe, CA (US); Doron Lurie, San Diego, CA (US); Bruce Moeller, San Diego, CA (US)

(73) Assignee: Leader Ventures, LLC, San Francisco, CA (US)

Reexamination Request:
No. 95/001,779, Oct. 11, 2011

Reexamination Certificate for:

| | |
|---|---|
| Patent No.: | **7,659,827** |
| Issued: | **Feb. 9, 2010** |
| Appl. No.: | **11/382,222** |
| Filed: | **May 8, 2006** |

Related U.S. Application Data

(63) Continuation-in-part of application No. 11/382,239, filed on May 8, 2006, now Pat. No. 8,314,708.

(51) Int. Cl.
*G09B 23/00* (2006.01)

(52) U.S. Cl.
USPC ..... 340/576; 348/148; 434/66

(58) Field of Classification Search
None
See application file for complete search history.

(56) References Cited

To view the complete listing of prior art documents cited during the proceeding for Reexamination Control Number 95/001,779, please refer to the USPTO's public Patent Application Information Retrieval (PAIR) system under the Display References tab.

*Primary Examiner* — Jalatee Worjloh

(57) ABSTRACT

Systems and methods for taking risk out of driving are presented. The system comprises an event capture device that records audio, video, and other information that collectively comprise an event. The event data, including the audio, video, and other related information, is provided to an evaluation server where it is stored in a database of events. Driving events can be analyzed singularly or collectively to provide counseling of fleet drivers, reconstruction and forensic analysis of automobile accidents, and driver and/or vehicle scores/ratings.

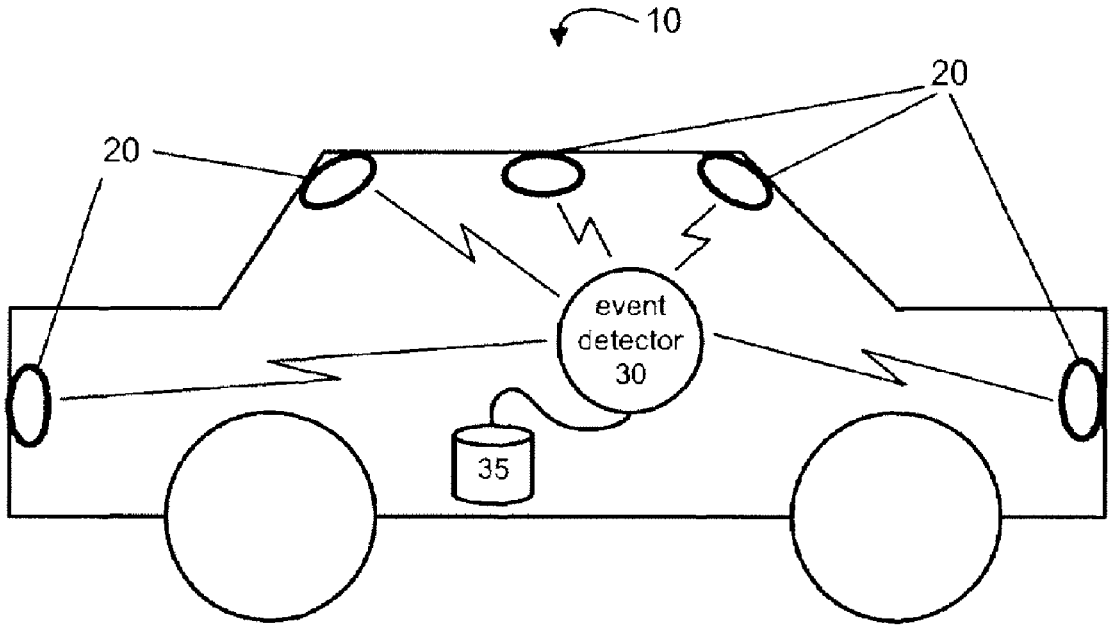

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 23 is confirmed.

Claims 14-22 and 24 are cancelled.

New claims 25-31 are added and determined to be patentable.

Claims 1-13 were not reexamined.

*25. The method of claim 14, wherein the analyzed demographic data includes an individual counseling session prepared for the individual driver.*

*26. The method of claim 14, wherein the analyzed demographic data includes information associated with a group counseling session viewed by the individual driver.*

*27. The method of claim 14, wherein scoring the individual driver includes using a type of a road at a location of the vehicle.*

*28. The system of claim 15, wherein the scoring criteria includes a formula utilizing a type of a road at a location of the vehicle.*

*29. The system of claim 15, wherein the correlation data includes a relationship between a known vehicle defect and an event caused by the known vehicle defect.*

*30. The system of claim 15, wherein the vehicle scoring data includes a vehicle score for a group of vehicles of a specified make.*

*31. The system of claim 15, wherein the vehicle scoring data includes a vehicle score for a group of vehicles of a specified class.*

* * * * *